US006868670B1

(12) United States Patent
Schellin

(10) Patent No.: US 6,868,670 B1
(45) Date of Patent: Mar. 22, 2005

(54) COMPACT, REDUCED BACKPRESSURE, VERTICAL EXHAUST WATER TRAP ASSEMBLY

(75) Inventor: Robert J. Schellin, New Glarus, WI (US)

(73) Assignee: FleetGuard, Inc., Nashville, TN (US)

( * ) Notice: Subject to any disclaimer, the term of this patent is extended or adjusted under 35 U.S.C. 154(b) by 93 days.

(21) Appl. No.: 10/376,424

(22) Filed: Feb. 28, 2003

(51) Int. Cl.[7] ..... F01N 3/02

(52) U.S. Cl. ..... 60/309; 60/312; 181/233; 181/269

(58) Field of Search ..... 60/309, 310, 312; 181/233, 234, 235, 265, 269

(56) References Cited

U.S. PATENT DOCUMENTS

| | | | | | |
|---|---|---|---|---|---|
| 2,446,631 | A | * | 8/1948 | Burks | 454/41 |
| 2,482,577 | A | | 9/1949 | Dahlstrom | |
| 2,721,619 | A | | 10/1955 | Cheairs | |
| 2,732,913 | A | | 1/1956 | Higgins | |
| 2,921,432 | A | * | 1/1960 | Marcotte et al. | 55/307 |
| 3,817,221 | A | | 6/1974 | Nohira et al. | |
| 4,450,934 | A | | 5/1984 | Davis | |
| 4,527,659 | A | | 7/1985 | Harrington | |
| 5,170,020 | A | | 12/1992 | Kruger et al. | |
| 5,321,215 | A | | 6/1994 | Kicinski | |
| 5,746,630 | A | | 5/1998 | Ford et al. | |
| 5,808,245 | A | | 9/1998 | Wiese et al. | |
| 6,152,258 | A | * | 11/2000 | Deavers et al. | 181/282 |
| 6,412,595 | B1 | * | 7/2002 | Horak et al. | 181/221 |
| 6,430,921 | B1 | * | 8/2002 | Stuart et al. | 60/309 |

FOREIGN PATENT DOCUMENTS

| | | | | |
|---|---|---|---|---|
| JP | 58202323 A | * | 11/1983 | F01N/1/08 |
| JP | 11-72018 | | 3/1999 | |

* cited by examiner

*Primary Examiner*—Tu M. Nguyen
(74) *Attorney, Agent, or Firm*—Andrus, Sceales, Starke & Sawall, LLP

(57) ABSTRACT

An exhaust water trap assembly has separated and spaced exhaust tubes, and a dome cap blocking entry of water to protect an upstream catalytic converter or soot filter. A first tube extends axially upwardly into a housing, and a second tube is spaced vertically thereabove. The dome cap on the top end of the first tube blocks exhaust flow axially upwardly therepast and blocks entry of water axially downwardly therepast.

5 Claims, 2 Drawing Sheets

COMPACT, REDUCED BACKPRESSURE, VERTICAL EXHAUST WATER TRAP ASSEMBLY

BACKGROUND AND SUMMARY

The invention relates to vertical exhaust systems and exhaust water trap assemblies, including for heavy duty vehicles, such as trucks, tractors, off-road equipment, and the like which utilize a vertical exhaust system, for example in which the exhaust conduit extends vertically alongside the cab of the vehicle.

For reduced emissions, catalytic converters and soot filters have been incorporated in the exhaust system of buses, trucks, and so on. If the exhaust outlet is vertical there is a possibility that water, such as rain, snow, or bus or truck wash, can enter the upper end of the exhaust system and flow downwardly into contact with the catalytic converter or soot filter unit. The water entering the system can be absorbed in the catalyst/filter mounting mat, e.g. vermiculite, that is typically located between the outer surface of the catalytic converter and the outer body of the exhaust conduit. Mounting mat that is exposed to water results in a much lower push out force, a measure of the ability for the mat to retain the catalyst/filter in place. In another scenario, freezing of water in the catalytic converter can cause structural damage to the monolithic catalyst. As an additional problem, water flowing through the catalytic converter or soot filter may tend to wash particulate material downwardly where such material collects and clogs the lower surface of the catalytic converter/soot filter causing premature failure thereof.

One solution to the above identified problem is shown in U.S. Pat. No. 5,321,215, incorporated herein by reference. As shown in the '215 patent, a perforated tube 15 extends vertically axially within a housing having an outer tubular body 2, and exhaust flows upwardly through tube 15 then radially outwardly through a first Set of perforations 19 into an annular chamber 16 then vertically upwardly through such annular chamber and then radially inwardly through a second set of perforations 20 back into tube 15 and then vertically upwardly for discharge. The tube is closed by a plug or closure 21 between the upper and lower sets of perforations 20 and 19. An annular or ring-shaped deflector is mounted on the outer surface of tube 15 and is located immediately beneath plug 21 and intermediate the two groups of perforations 19 and 20. Any moisture flowing downwardly within the upper chamber 25 of tube 15 will flow outwardly through the lowermost perforations of the upper group 20 and be deflected radially outwardly by deflector 26 into the noted annular chamber 16 and be collected in a trap 27 above a lower flange 17, for drainage through a drain opening 28 in outer tubular body 2.

In another known solution to the above identified problem, a plurality of vertically upwardly extending inlet tubes circumferentially surround and axially overlap a downwardly extending central outlet tube, known as the Gatling Gun design. In this design, water entering the system through the outlet tube flows vertically downwardly therealong and does not enter the inlet tubes because the top ends of the inlet tubes are laterally offset from and vertically above the lower end of the central outlet tube.

The present invention provides another solution to the above identified problem. The present invention provides a short vertical axial length for easy vehicle packaging, freedom to modify outlet tube size and location, and further provides reduced backpressure and lower production costs.

In one aspect of the invention, vertical height is shortened by eliminating internal exhaust tube portions. In another aspect, reduced backpressure is provided by eliminating the re-introduction of exhaust into a perforated exhaust tube prior to discharge, for example eliminating re-introduction of exhaust through the upper group of perforations 20 in the above noted '215 patent. In another aspect, backpressure is reduced by separating inlet and outlet exhaust tubes, and providing an open unobstructed plenum therebetween free of an exhaust tube otherwise extending axially therethrough. In another aspect, backpressure is reduced by separating the inlet and outlet exhaust tubes, to enable a larger inlet tube into a plenum providing a larger area for perforations, without limiting the diameter of the inlet tube to that of the outlet tube otherwise dictated by downstream system requirements. In another aspect, backpressure is reduced by eliminating 180° bends in exhaust flow otherwise required between axially overlapped laterally offset inlet and outlet tubes, such as in the above noted Gatling Gun design. In another aspect, the invention provides lower production cost by eliminating full circle leak-proof welds around each of a plurality of inlet tubes as in a Gatling Gun design, required to prevent water leakage therepast.

DETAILED DESCRIPTION

Figure 1:
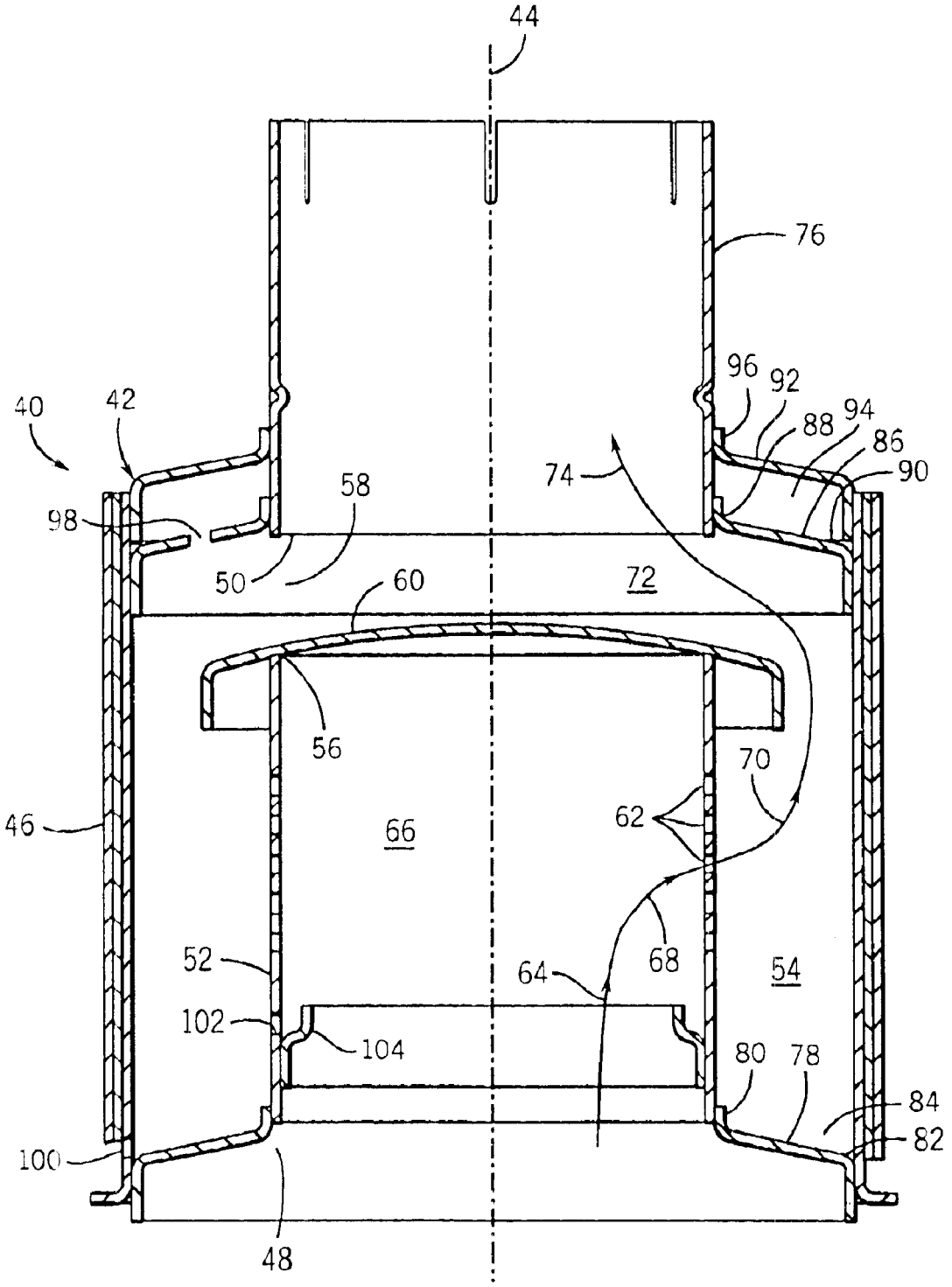
FIG. 1 is a side sectional view of an exhaust water trap assembly in accordance with the invention.

FIG. 1 shows an exhaust water trap assembly 40 including a housing 42 extending axially along a vertical axis 44 and having a housing sidewall 46. The housing has a lower inlet 48 for receiving exhaust from an internal combustion engine through a catalytic converter or soot filter, and an upper outlet 50 for discharging the exhaust and which is spaced above lower inlet 48. An internal exhaust tube 52 extends upwardly from lower inlet 48 and is spaced radially inwardly of housing sidewall 46 by a radial gap defining an annular space 54 therebetween. Exhaust tube 52 has a top end 56 vertically spaced below upper outlet 50 by an axial gap 58. A dome cap or umbrella 60 on top end 56 spans internal exhaust tube 52 and blocks exhaust flow axially upwardly therepast, and blocks entry of water axially downwardly therepast into top end 56 of internal exhaust tube 52 from upper outlet 50 and instead diverts and sheds water radially outwardly into annular space 54. Exhaust tube 52 is perforated as shown at perforations 62, and hence exhaust flows axially upwardly as shown at arrow 64 from the internal combustion engine and the catalytic converter into assembly 40 through lower inlet 48 into interior 66 of internal exhaust tube 52, and then flows radially outwardly through perforations 62 as shown at arrow 68 into annular space 54 and then flows axially upwardly as shown at arrow 70 through annular space 54 past dome cap 60 and then into an upper plenum 72 and then to outlet 50 as shown at arrow 74 for discharge vertically axially upwardly through external exhaust tube 76.

A lower annular flange 78 has an inner circumference 80 at internal exhaust tube 52 and defining lower inlet 48, and has an outer circumference 82 at housing sidewall 46 and spanning and closing annular space 54 at a lower end thereof to form a collection space and water trap 84, comparable to water trap 27 in the noted '215 patent. An upper flange 86 has an inner circumference 88 spaced vertically above top end 56 of internal exhaust tube 52 and dome cap 60 by axial gap 58 and defining the noted upper outlet 50, and has an outer circumference 90 at housing sidewall 46. Dome cap 60 and upper flange 86 define upper outlet plenum 72 free of a perforated exhaust tube extending axially therethrough and into which exhaust would otherwise have to be re-introduced and which would otherwise increase restriction, for example, in the '215 patent, eliminating re-introduction of exhaust into exhaust tube 15 through perforations 20. Upper outlet plenum 72 unobstructedly fully occupies the lateral cross-sectional area of housing 42, without an exhaust tube, such as 15 of the '215 patent, extending axially therethrough.

External exhaust tube 76 extends upwardly from upper outlet 50 at upper annular flange 86. In one embodiment, a second upper annular flange 92 is spaced above upper annular flange 86 by an axial gap defining an upper annular space 94 axially between flanges 86 and 92 and radially between external exhaust tube 76 and housing sidewall 46. Each of upper annular flanges 86 and 92 has an inner circumference 88 and 96, respectively, mounted to external exhaust tube 76 at axially spaced locations therealong. This is desirable because it provides reinforcement against lever arm bending of exhaust tube 76 or extensions thereof, typically encountered in mounting of the exhaust system and in service during road and/or engine vibration. In a further embodiment, upper annular flange 86 may have one or more openings such as 98 therethrough communicating with upper annular space 94 to provide a resonant chamber in space 94, for cancellation or damping of designated frequencies or harmonics.

In a desirable aspect, the construction of the present invention separates and spaces first and second tubes 52 and 76, respectively. Second tube 76 is separate from and spaced vertically above first tube 52 by axial gap 58 therebetween defining upper outlet plenum 72 laterally spanning housing 42 above annular space 54 and above top end 56 of first tube 52. Tube 76 extends axially upwardly from the housing for discharging exhaust. Dome cap 60 on top end 56 of tube 52 blocks exhaust flow axially upwardly therepast, such that exhaust flows through the perforated portion of tube 52 as shown at arrow 68 through perforations 62 into annular space 54 then into plenum 72 then to tube 76. Dome cap 60 blocks entry of water axially downwardly therepast into top end 56 of tube 52 from tube 76 thereabove and instead diverts and sheds water radially outwardly into annular space 54. Annular flange 78 extends laterally between first tube 52 and housing sidewall 46 below top end 56 of tube 52 and defines collection space 84 for water shed from dome cap 60 into annular space 54. Flange 78 is preferably at the lower end of tube 52. Housing sidewall 46 has one or more drain holes 100 therethrough above flange 78 for draining water from collection space 84. If moisture collects in space 84 to the level of drain 100, the excess moisture will drain outwardly of sidewall 46.

A portion of the moisture flowing outwardly on dome cap or umbrella 60 may flow inwardly through perforations 62 and along the inner surface of tube 52. This moisture flowing along the inner surface of tube 52 will be directed outwardly through the lowermost row of perforations 102 by a ring 104 secured to the inner surface of tube 52, comparably to ring 22 in the '215 patent. This moisture sill then flow along the outer surface of tube 52 and be collected in collection space or trap 84. Most moisture collected in space 84 will drain through hole 100, however when the engine is started, any remaining moisture collected in collection space or trap 84 will be heated and evaporated and the vapor will pass out of the assembly through annular space 54 then upwardly as shown at arrows 70 and 74.

Figure 2:
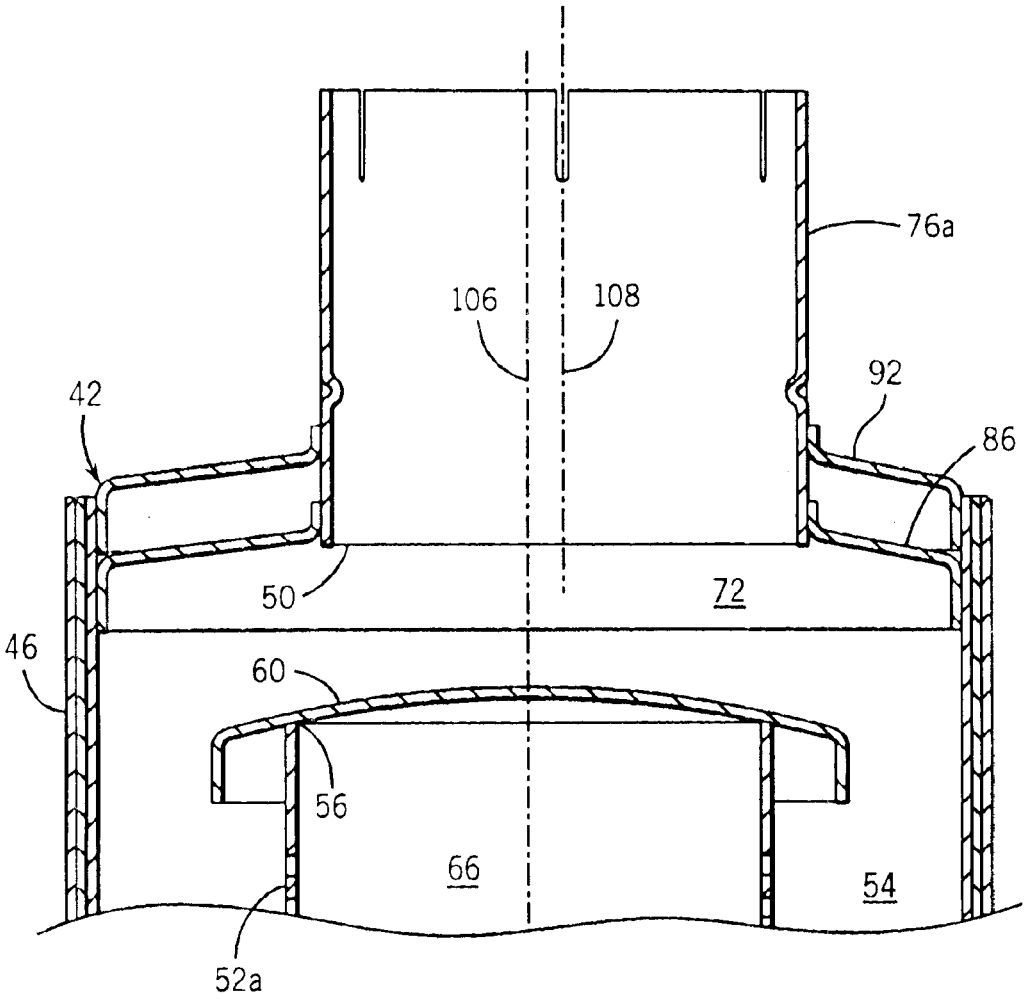
FIG. 2 is a view of a portion of FIG. 1 and showing an alternate embodiment.

In a desirable aspect of the invention, the separation of tubes 52 and 76 (instead of a single tube 15 as in the '215 patent) enables the first tube 52 to have a different diameter than the second tube 76. This is desirable in applications where the second tube 76 is limited or required to be of a certain diameter, e.g. 4", to match system requirements, yet allowing the first tube 52 to be a larger diameter, e.g. 6", to reduce restriction, backpressure, and to improve flow distribution across the catalyst or soot filter. If tubes 52 and 76 are a single unitary tube, then the diameter thereof must match system requirements, including outlet dimensional requirements, which in turn limits the diameter of the internal exhaust tube to a diameter which may unnccessarily introduce restriction or increase backpressure. Different diameter separated tubes 52*a* and 76*a* are illustrated in FIG. 2, which uses like reference numerals from above where appropriate to facilitate understanding.

First tube 52 extends along a first axial centerline, and second tube 76 extends along a second axial centerline. In one embodiment, the noted axial centerlines are axially aligned with each other as shown at 44, FIG. 1. In another embodiment, FIG. 2, the axial centerline 106 of first tube 52*a* is laterally offset from the axial centerline 108 of the second tube 76*a*. This affords packaging flexibility, which has been particularly encountered in various bus applications where the customer has desired such offset for accommodating restricted compartments in the exhaust system.

It is recognized that various equivalents, alternatives and modifications are possible within the scope of the appended claims.

What is claimed is:

1. An exhaust water trap assembly comprising a housing extending axially along a vertical axis and having a housing sidewall, said housing having a lower inlet for receiving exhaust from an internal combustion engine, and an upper outlet for discharging said exhaust and spaced above said lower inlet, an internal exhaust tube extending upwardly from said lower inlet and spaced radially inwardly of said housing sidewall by a radial gap defining an annular space therebetween, said exhaust tube having a top end vertically spaced below said upper outlet by an axial gap, a dome cap on said top end of and spanning said internal exhaust tube and blocking exhaust flow axially upwardly therepast and blocking entry of water axially downwardly therepast into said top end of said internal exhaust tube from said upper outlet and instead diverting and shedding said water radially outwardly into said annular space, and comprising a lower annular flange having an inner circumference at said internal exhaust tube and defining said lower inlet, and having an outer circumference at said housing sidewall and spanning and closing said annular space at a lower end thereof to form a collection space for said water, said housing sidewall having one or more drain holes therethrough for draining water from said collection space, an upper annular flange having an inner circumference spaced vertically above said top end of said internal exhaust tube and said dome cap by said axial gap and defining said upper outlet, and having an outer circumference at said housing sidewall, wherein said dome cap and said upper flange define an upper outlet plenum free of a perforated exhaust tube extending axially therethrough and into which exhaust would otherwise have to be re-introduced and which would otherwise increase restriction.

2. An exhaust water trap assembly comprising a housing extending axially along a vertical axis and having a housing sidewall, said housing having a lower inlet for receiving exhaust from an internal combustion engine, and an upper outlet for discharging said exhaust and spaced above said lower inlet, an internal exhaust tube extending upwardly from said lower inlet and spaced radially inwardly of said housing sidewall by a radial gap defining an annular space therebetween, said exhaust tube having a top end vertically spaced below said upper outlet by an axial gap, a dome cap on said top end of and spanning said internal exhaust tube and blocking exhaust flow axially upwardly therepast and blocking entry of water axially downwardly therepast into said top end of said internal exhaust tube from said upper outlet and instead diverting and shedding said water radially outwardly into said annular space, and comprising a lower annular flange having an inner circumference at said internal exhaust tube and defining said lower inlet, and having an outer circumference at said housing sidewall and spanning and closing said annular space at a lower end thereof to form a collection space for said water, said housing sidewall having one or more drain holes therethrough for draining water from said collection space, an upper annular flange having an inner circumference spaced vertically above said top end of said internal exhaust tube and said dome cap by said axial gap and defining said upper outlet, and having an outer circumference at said housing sidewall, wherein said dome cap and said upper flange define an upper outlet plenum, and said upper outlet plenum fully occupies the entire lateral cross-sectional area of said housing without an exhaust tube extending axially therethrough.

3. An exhaust water trap assembly comprising a housing extending axially along a vertical axis and having a housing sidewall, a first tube extending axially upwardly into said housing and having a perforated portion in said housing, said first tube having a lower inlet end for receiving exhaust from an internal combustion engine, and having a top end in said housing, said first tube being spaced radially inwardly of said housing sidewall by a radial gap therebetween defining an annular space, a second tube separate from said first tube and spaced vertically above from said first tube by an axial gap therebetween defining an upper outlet plenum laterally spanning said housing above said annular space and above said top end of said first tube, said second tube extending axially upwardly from said housing for discharging exhaust, a dome cap on said top end of said first tube and blocking exhaust flow axially upwardly therepast, such that exhaust flows through said perforated portion of said first tube into said annular space then into said plenum then to said second tube, said dome cap blocking entry of water axially downwardly therepast into said top end of said first tube from said second tube thereabove and instead diverting and shedding said water radially outwardly into said annular space, wherein said first tube extends axially along a first axial centerline, said second tube extends axially along a second axial centerline, and wherein said first and second axial centerlines are laterally offset from each other.

4. An exhaust water trap assembly comprising a housing extending axially along a vertical axis and having a housing sidewall, said housing having a lower inlet for receiving exhaust from an internal combustion engine, and an upper outlet for discharging said exhaust and spaced above said lower inlet, an internal exhaust tube extending upwardly from said lower inlet and spaced radially inwardly of said housing sidewall by a radial gap defining an annular space therebetween, said exhaust tube having a top end vertically spaced below said upper outlet by an axial gap, a dome cap on said top end of and spanning said internal exhaust tube and blocking exhaust flow axially upwardly therepast and blocking entry of water axially downwardly therepast into said top end of said internal exhaust tube from said upper outlet and instead diverting and shedding said water radially outwardly into said annular space, and comprising a lower annular flange having an inner circumference at said internal exhaust tube and defining said lower inlet, and having an outer circumference at said housing sidewall and spanning and closing said annular space at a lower end thereof to form a collection space for said water, said housing sidewall having one or more drain holes therethrough for draining water from said collection space, an upper annular flange having an inner circumference spaced vertically above said top end of said internal exhaust tube and said dome cap by said axial gap and defining said upper outlet, and having an outer circumference at said housing sidewall, an external exhaust tube extending upwardly from said upper outlet at said upper annular flange, and a second upper annular flange spaced above said first mentioned upper annular flange by an axial gap defining an upper annular space between said external exhaust tube and said housing sidewall, each of said upper annular flanges having an inner circumference mounted to said external exhaust tube at axially spaced locations therealong.

5. The exhaust water trap assembly according to claim 4 wherein said first upper annular flange has one or more openings there through communicating with said upper annular space to provide a resonant chamber therein.

* * * * *